United States Patent [19]

Forbriger et al.

[11] 4,023,718

[45] May 17, 1977

[54] SEALING AND CLOSURE STRUCTURE FOR A SPRAY DISPENSING DEVICE

[75] Inventors: Arthur W. Forbriger, Indian Hill, Ohio; Carl E. Meyerhoefer, Little Neck, N.Y.

[73] Assignee: Revlon-Realistic Professional Products, Inc., Cincinnati, Ohio

[22] Filed: Mar. 14, 1975

[21] Appl. No.: 558,346

Related U.S. Application Data

[63] Continuation-in-part of Ser. No. 458,107, April 4, 1974, abandoned.

[52] U.S. Cl. ..... 222/399; 222/400.7; 222/545; 239/367; 239/397; 137/322

[51] Int. Cl.[2] ..... B65D 83/00

[58] Field of Search ..... 222/400.7, 545, 400.8, 222/399, 373; 239/390, 297, 367; 137/322

[56] References Cited

UNITED STATES PATENTS

| | | | |
|---|---|---|---|
| 3,498,313 | 3/1970 | Belich | 222/400.7 |
| 3,604,602 | 9/1971 | Lee | 222/400.7 |
| 3,650,479 | 3/1972 | Liedberg | 237/527 |
| 3,705,689 | 12/1972 | Lee | 239/337 |

*Primary Examiner*—Allen N. Knowles
*Attorney, Agent, or Firm*—James W. Pearce; Roy F. Schaeperklaus

[57] ABSTRACT

A spray dispenser including a hollow casing, having sockets in each of which a pair of O-ring seals is mounted. A ball valve is urged toward one of the O-ring seals of each socket. A housing is removably mounted in the casing. Hollow lugs on the housing each having a cylindrical outer face are received inside O-ring seals in sealing relation therewith. Each lug unseats the associated ball valve. When the housing is removed, the ball valve seats against one O-ring seal when the housing is removed from the casing while the lug is in sealing engagement with the other O-ring seal. Compressed air and liquid under pressure are directed through the sockets to a dispensing valve member on the housing, and the pressure need not be released when the housing is removed.

19 Claims, 21 Drawing Figures

SEALING AND CLOSURE STRUCTURE FOR A SPRAY DISPENSING DEVICE

This is a continuation-in-part of our copending application Ser. No. 458,107 filed Apr. 4, 1974, now abandoned.

This invention relates to a spray dispensing device which is powered by compressed air or the like.

An object of this invention is to provide a spray device of this type which is provided with a dispensing head which can be readily removed and replaced.

A further object of this invention is to provide a device of this type having a replaceable spray head which can be removed and replaced without disconnecting of pressure connections of the device.

A further object of this invention is to provide such a device in which there are automatic valves on pressure lines which close as the dispensing head is removed to prevent discharge of pressurized fluids.

A further object of this invention is to provide a closure construction for a liquid supply bottle for such a dispensing head in which compressed air urges the liquid from the bottle to the dispensing head.

Briefly, this invention provides a spray dispensing assembly which includes a stand on which a bottle is supported in inverted position. A plug mounted in the neck of the bottle is provided with a spout through which liquid from the bottle is discharged. An air pressure tube extends upwardly into the bottle from the plug. Air is directed through the air tube to cause discharge of the liquid. An intermediate fitting assembly between a cap of the closure and the plug provides seals between the neck of the bottle and air and liquid mounts. The seals are coaxial with threads of the cap which hold the intermediate fitting assembly in place and the seals are independent of the tightness with which the cap is mounted. A liquid line from the spout is connected to a spray dispensing casing arrangement which permits disconnection of a dispensing head without release of pressure in the bottle. A socket in the casing carries a pair of O-ring seals. A ball valve is normally urged against one of the O-ring seals to close the opening thereof. The head includes a housing having a hollow lug which can be received inside the O-ring seals and can be advanced to cause release of the ball valve. When the lug is withdrawn, the ball valve seats against said one of the O-ring seals while the lug remains sealed inside the other of the O-ring seals so that the head can be removed without loss of liquid. A similar seal arrangement can be provided for an air line.

The above and other objects and features of the invention will be apparent to those skilled in the art to which this invention pertains from the following detailed description and the drawings, in which.

Figure 18:
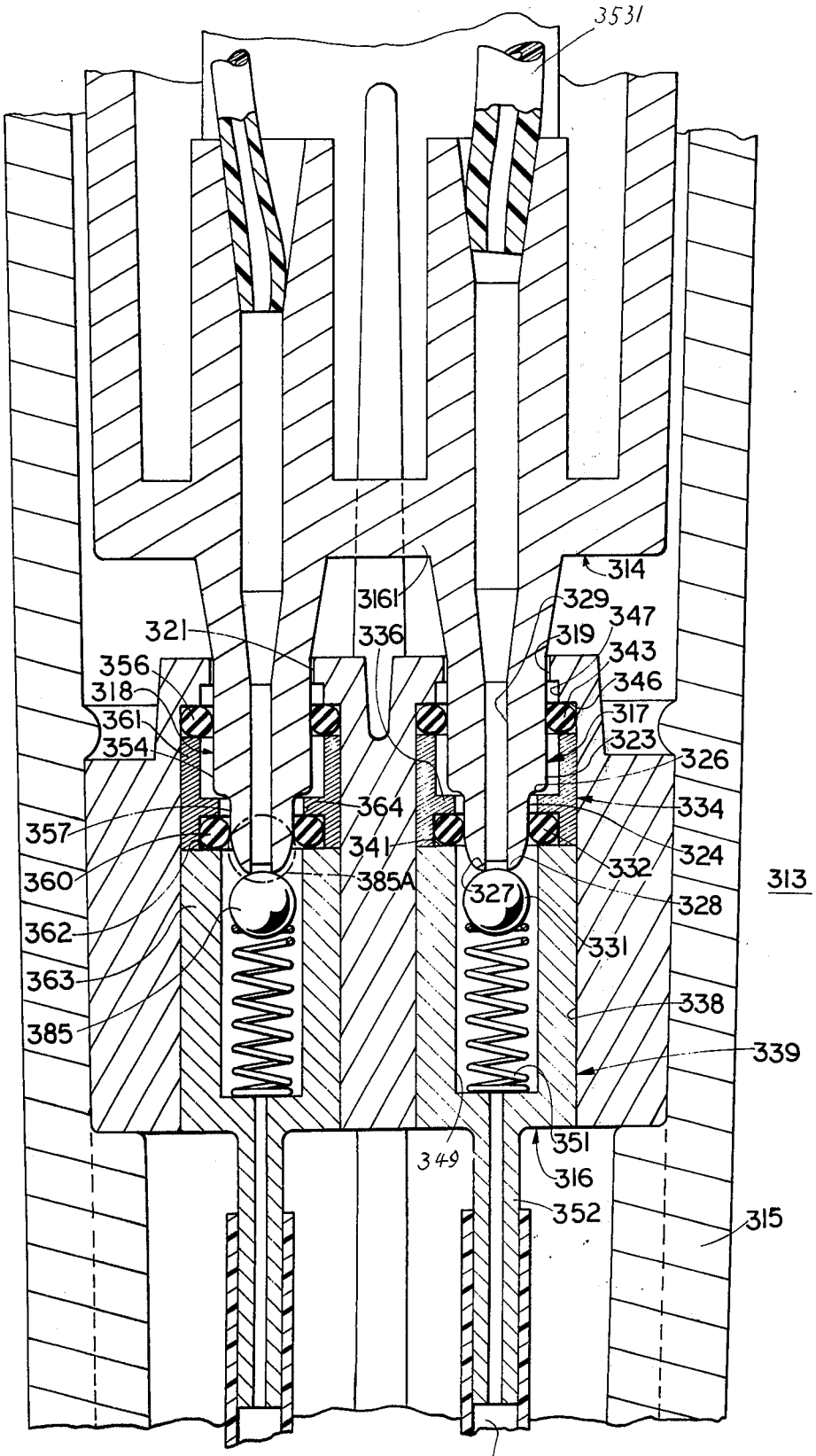
Figure 19:
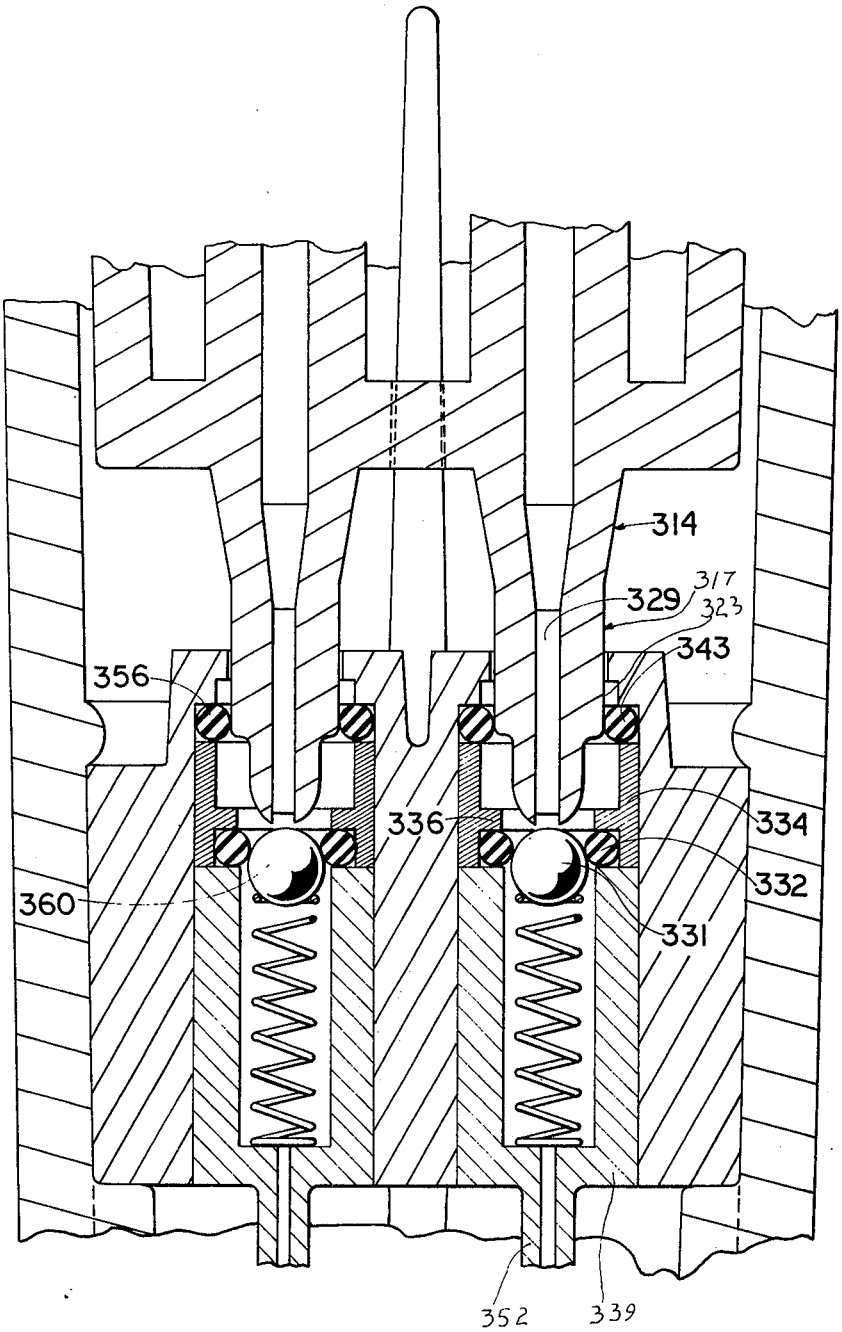

FIG. 18 is a fragmentary view in transverse section of a dispensing head assembly constructed in accordance with another embodiment of this invention shown in assembled relation, a valve closed position of one of a pair of ball valves thereof being shown in dot-dash lines; and FIG. 19 is a fragmentary view in transverse section of the dispensing head assembly shown in FIG. 18 in partly disassembled relation.

In the following detailed description and the drawings, like reference characters indicate like parts.

Figure 1:
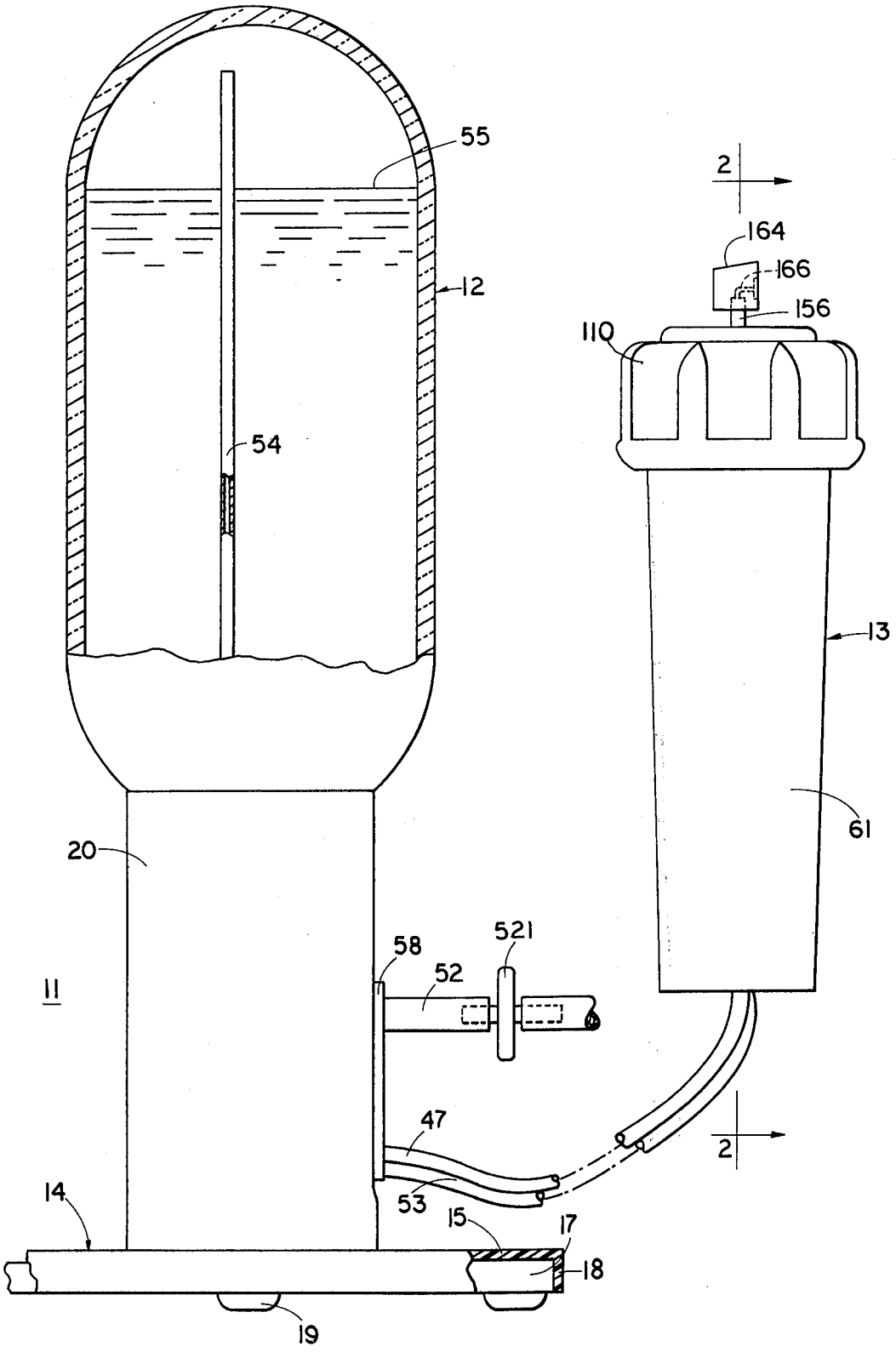
FIG. 1 is a view partly in side elevation and partly in upright section of a spray dispensing device constructed in accordance with an embodiment of this invention.

As shown in FIG. 1, the spray device includes a bottle holding assembly 11, a liquid supply bottle 12 supported thereon, and a dispensing head assembly 13.

Figure 6:
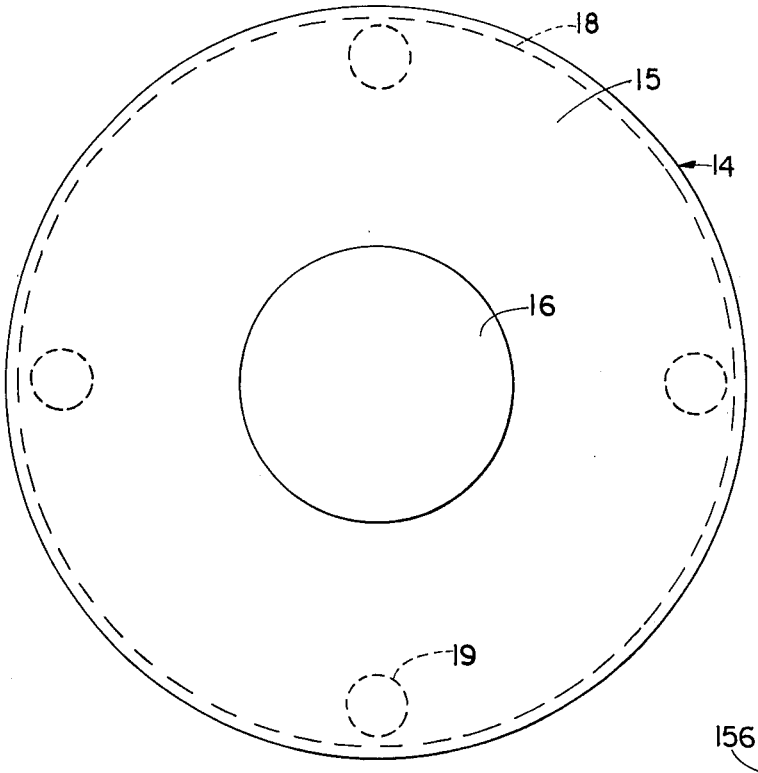
FIG. 6 is a top plan view of a bottle holder of the device.
Figure 10:
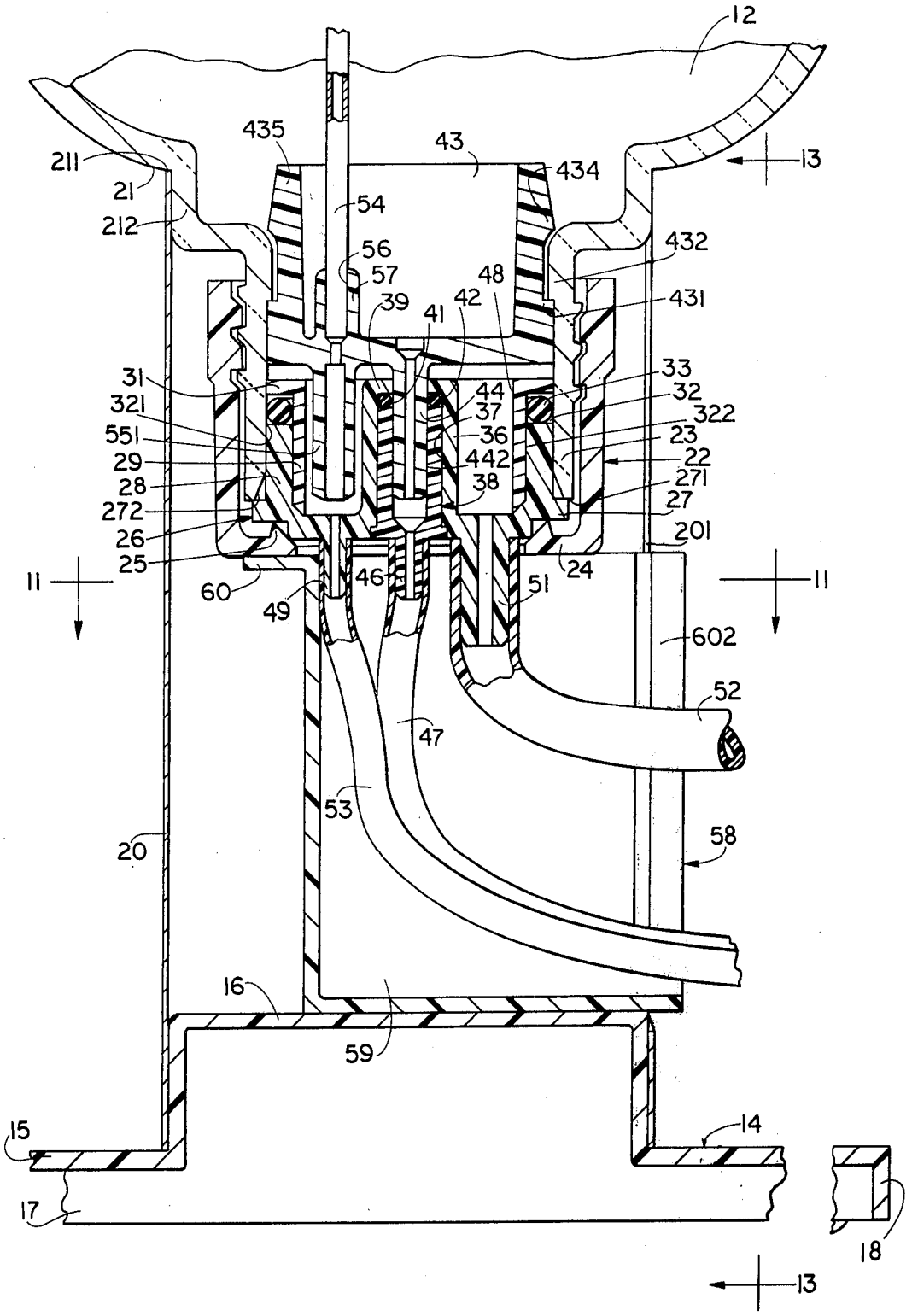
FIG. 10 is a view in upright section showing a bottle supporting structure of the device illustrated in FIG. 1.
Figure 11:
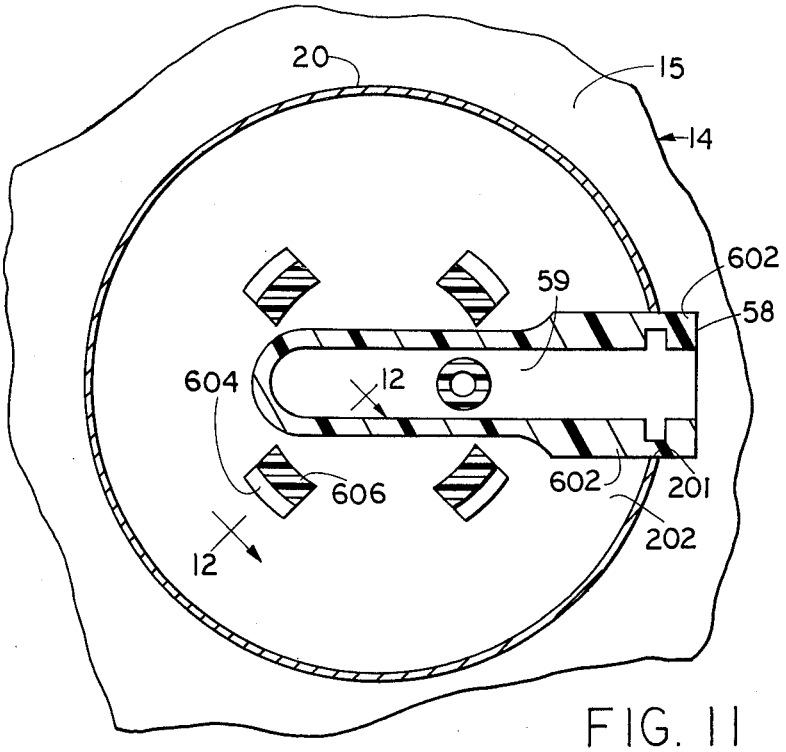
FIG. 11 is a view in section taken on the line 11—11 in FIG. 10.
Figure 13:
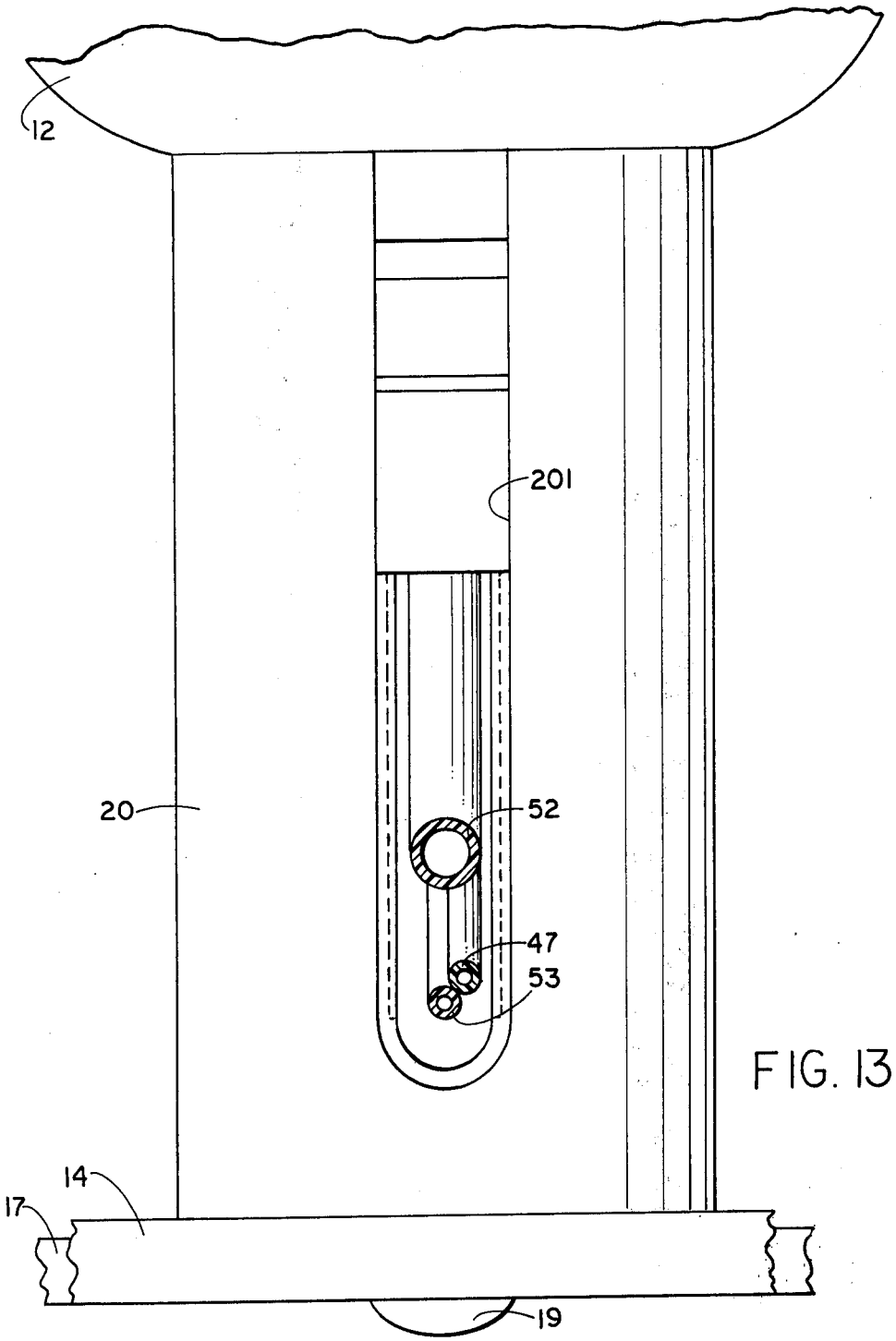
FIG. 13 is a side elevational view taken in the direction of the arrows 13—13 in FIG. 10.

The bottle holding assembly includes a molded stand 14 (FIGS. 1 and 6) including an annular base plate portion 15 and an upwardly extending central lug or boss 16. A heavy metal plate 17 (FIG. 1) is received inside a downwardly extending annular peripheral flange 18 of the plate portion 15. The plate 17 can be adhesively attached to the plate portion 15 and serves to stabilize the bottle holder assembly 11 to prevent tipping thereof. Appropriate spaced feet 19 of rubber or other rubber-like material are attached to the underside of the plate 17. A metal tube or ring member 20 is mounted on the boss 16 as shown in FIG. 10 and extends upwardly therefrom. An upright slot 201 (FIG. 13) is formed in the ring member 20. The bottle 12 (FIG. 10) is supported on the ring member 20 in inverted position. An annular shoulder 21 of the bottle rests on an upper edge 211 of the ring member 20 with a cylindrical portion 212 of the bottle received inside the ring member 20 in frictional relationship therewith.

A cap 22 is threaded on a neck 23 of the bottle 12. An inwardly directed flange 24 on the cap 22 carries an annular upwardly extending rib 25 which supports a first fitting 26. The fitting 26 includes an outwardly extending flange 27, which underlies a mouth 271 of the bottle 12, and an upwardly extending annular wall 28 which fits inside the neck 23 of the bottle 12. An annular second fitting 29 is received inside the wall 28 in pressed fit air-sealing relation therewith. An outwardly extending annular flange 31 on the second fitting 29 overlies the wall 28 with an annular space 32 being formed between the bottle neck 23, the first fitting 26 and the second fitting 29. A first O-ring seal 33 is received in the annular space 32 to form a seal between the bottle 12, and the second fitting 29. The interior of the neck 23 of the bottle adjacent the mouth 271 is provided with a chamfered edge 272 to permit easy assembly of the bottle 12 and the fitting 26. The O-ring seal 33 engages an inner face 321 of the neck 23 of the bottle 12 and an outer face 322 of the second fitting 29. The faces 321 and 322 are right circular cylindrical faces and are coaxial so that the O-ring seal 133 forms a seal therebetween even if not in engagement with the flange 31 on the wall 28.

The first fitting 26 includes an annular inner wall 36 which defines a socket 37 in which a main portion of an annular third fitting 38 is received in pressed fit sealing relation. An inwardly extending annular flange 39 at the upper end of the wall 36 defines an annular space 41 overlying the third fitting 38 in which a second O-ring seal 42 is received.

Figure 15:
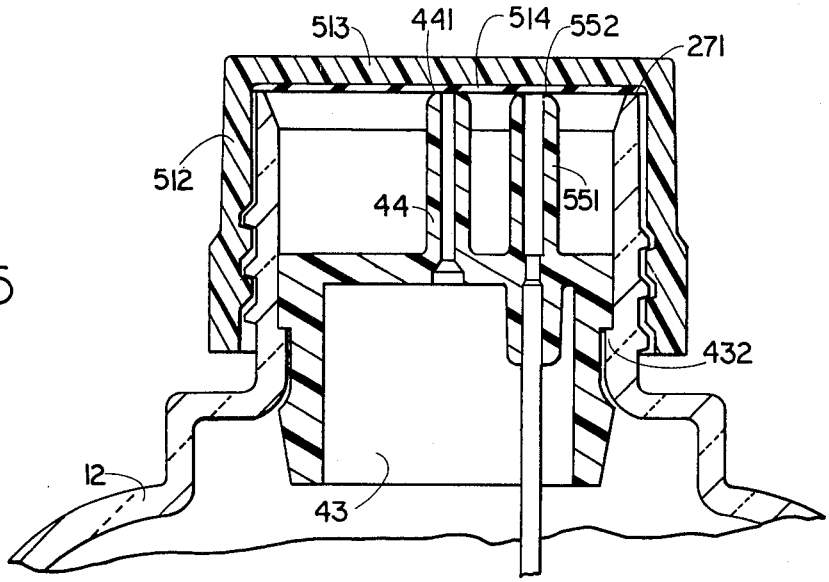
FIG. 15 is a view in upright section of an upper portion of the bottle with a shipping cap mounted on the mouth thereof.

A generally cup-shaped plug 43 is mounted inside the neck 23 of the bottle 12. An annular shoulder 431 on the plug 43 can engage an annular inwardly directed shoulder 432 at the upper end of the inner face 321 of the neck 23 of the bottle 12 to limit the distance the plug is inserted into the bottle. An outwardly directed flange 434 on a skirt 435 of the plug holds the plug inside the neck 23. A downwardly extending spout portion 44 of the plug 43 is received inside the O-ring seal 42, and the O-ring seal 42 provides a seal between the spout portion 44, the first fitting 26 and the third fitting 38. An outer wall 442 of the spout portion 44 is a right circular cylinder, and the inner face of the socket 37 in the first fitting 26 is also a right circular cylinder, and the second O-ring seal forms a seal between the first fitting 26 and the spout portion 44 irrespective of the precise positioning of the first fitting 26 inside the neck of the bottle. The inner wall 321 of the neck 23 of the bottle 12, which engages the O-ring seal 33, and the outer wall 442 of the spout portion 44 are both coaxial with threads between the neck 23 and the cap 22. A downwardly projecting spout 46 on the third fitting 38 receives an end portion of a tube 47, which receives liquid from the interior of the bottle 12 through the plug spout 44 and the spout 46 of the third fitting 38. An annular opening 48 is provided inside the first fitting 26 surrounding the inner wall 36 and inside the second fitting 29. Downwardly extending tubular mounts 49 and 51 carried on the first fitting 26 communicate with the opening 48. An air supply line 52 is carried by the tubular mount 51. An air pressure line 53 is carried by the tubular mount 49. The opening 48 also communicates with a tube 54 which is mounted in a socket 56 in a boss 57 of the plug 43 and extends upwardly as shown in FIG. 1 to above the level 55 of liquid in the bottle 12. A spout 551 mounted on the plug 43 communicates with the interior of the tube 54 and also extends into the opening 48. Thus, air under pressure from the air supply line is directed through the tube 54 into the space above the liquid in the bottle in operative position and also through the air pressure line 53. The O-ring seals 33 and 42 insure a seal between the bottle 12, the air lines 52 and 53 and the liquid line 47 even if there is relative movement between the plug 43 and the fitting assembly consisting of the fittings 26, 29, and 38, and the seal is not broken even if the cap 22 is not fully tightened on the neck of the bottle 12. Moreover, the fitting assembly can be turned with reference to the plug 43, and the seals are effective through 360° of rotation of the fitting assembly about the spout 44 of the plug 43. When the bottle 12 is not in use or is to be shipped, it can be dismounted from the ring member 20 and removed with the plug 43. As shown in FIG. 15, free ends 441 and 552 of the tubular spouts 44 and 551, respectively, are coplanar with the mouth 271 of the bottle 12 when the plug 43 is seated on the shoulder 432. A closure cap 512 having a flat outer wall 513 can be threaded on the neck of the bottle 12, and a resilient pad 514 mounted on the flat outer wall 513 engages and closes both of the tubular spouts 44 and 551 and also closes the mouth 271 of the bottle 12 to prevent escape of the liquid in the bottle beyond the plug 43.

Figure 12:
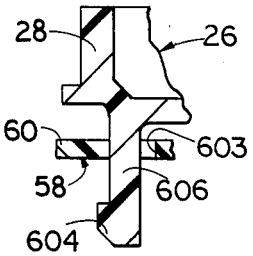
FIG. 12 is a fragmentary view in section taken on the line 12—12 in FIG. 11.
Figure 14:
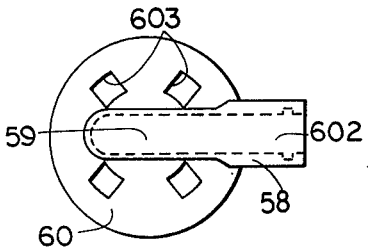
FIG. 14 is a bottom plan view of a cable guide member of the device.

The tubes or lines 47, 52, and 53 extend downwardly from the first fitting 26 (FIG. 10) inside a guide member 58. As shown in FIG. 1, a check valve 521 can be positioned in the air line 52 to prevent back flow from the bottle 12. The guide member 58 includes a hollow body 59 (FIGS. 10 and 14) and a flange 60 at the upper end of the body 59. The body 59 is open at the top and at one side, and a guide portion 602 thereof extends through the upright slot 201 (FIG. 10) in the tube 20. The flange 60 is provided with slots 603 (FIG. 14) which receive hook-shaped lower ends 604 (FIG. 12) of arms 606 which form a part of the first fitting 26 to connect the guide member 58 to the first fitting 26. The material of the first fitting 26 is sufficiently resilient that the arms 606 can be swung inwardly to permit the lower ends to snap into the slots 603.

The tubes 47 and 53 (FIG. 1) extend to the dispensing head assembly 13. The tube 52 is connected to an appropriate source of air under pressure. The check valve 521 (not shown in detail) permits passage of air under pressure from right to left, as shown in FIG. 1, but prevents back flow in the event of reduced pressure in the line 52. The tube 53 carries air under pressure to the dispensing head assembly. The tube 47 carries liquid to the dispensing head assembly 13.

Figure 3:
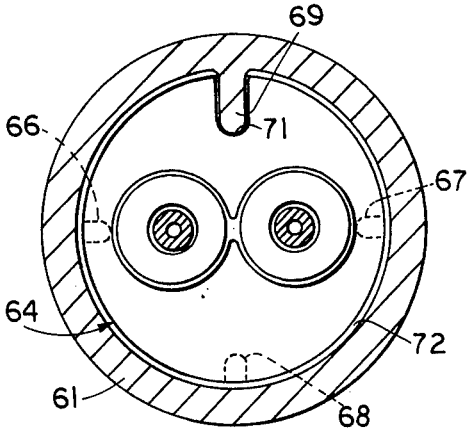
FIG. 3 is a view in section taken on the line 3—3 in FIG. 2.

The dispensing head assembly 13 includes a hollow casing 61 (FIG. 2) having a central opening 62 in a bottom wall 63 through which the tubes 47 and 53 extend into the casing 61. A plug 64 is seated inside the casing 61 and rests on upper ends of ribs 66, 67, and 68 (FIG. 3), which are molded on the interior of the wall of the casing 61. A longer rib 69 is received in a slot 71 in the plug 64 to align the plug 64 inside the casing 61. An inwardly extending annular rib 72 (FIG. 2) on the interior of the wall of the casing 61 holds the plug 64 in position in the casing 61.

Figure 8:
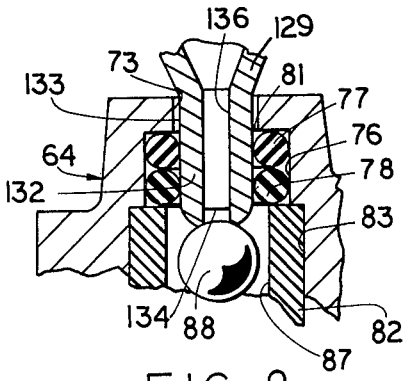
FIG. 8 is an enlarged fragmentary view in section taken on the same line as FIG. 2.

Doubly counterbored upright bores 73 and 74 are formed in the plug 64. Details of construction of an upper portion of the bore 73 are shown in FIG. 8. In an intermediate counterbore portion 76 of the doubly counterbored bore 73 are mounted O-ring seals 77 and 78, which are arranged in axially aligned or tandem relation. The O-ring seals 77 and 78 are of equal inner and outer diameters. The counterbore portion 76 has an annular cylindrical inner wall which is engaged by the O-ring seals 77 and 78. The upper edge of the upper ring 77 engages a shoulder 81 between the bore 73 and the intermediate counterbore portion 76. The lower edge of the lower ring 78 is engaged by an upper edge of an annular ball valve guiding fitting 82 received in a doubly counterbored portion 83 of the bore 73.

Figure 2:
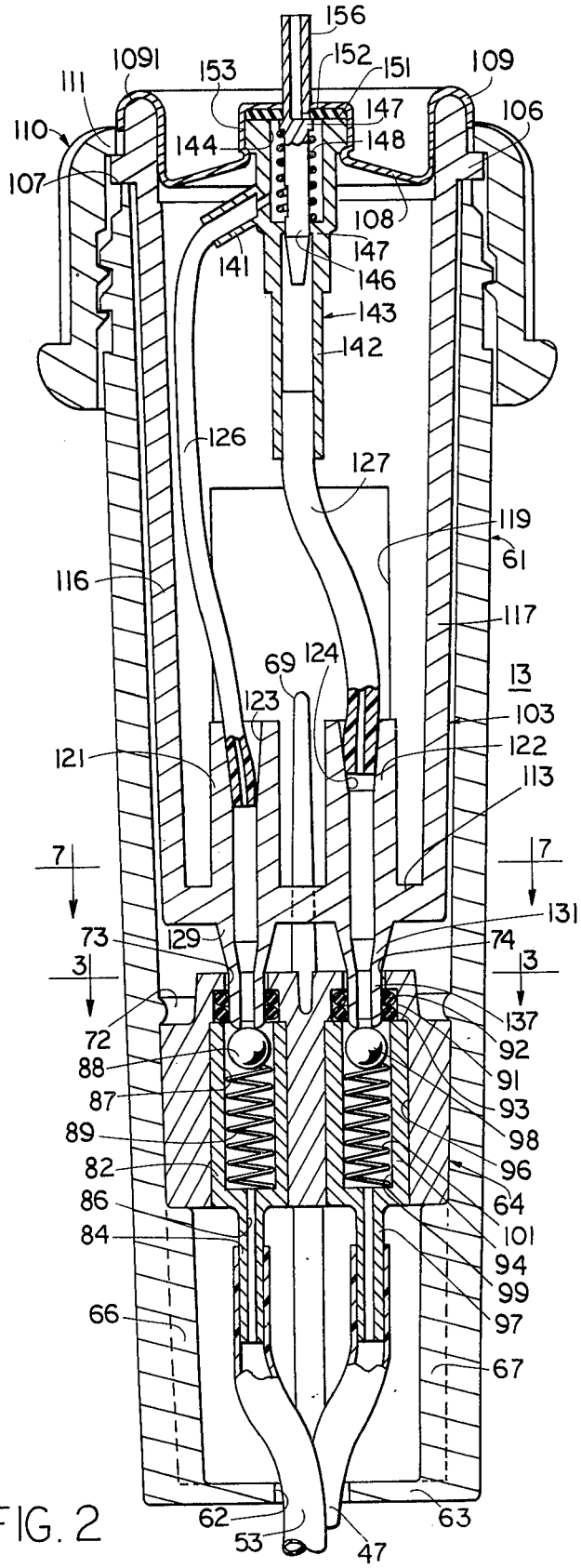
FIG. 2 is a view in section taken on the line 2—2 in FIG. 1, a dispensing cap of the device being omitted for clarity.

As shown in FIG. 2, the fitting 82 includes a downwardly extending tubular lower portion 84 on which the tube 53 is mounted. An opening 86 of the tubular portion 84 communicates with a counterbore 87 in which a valve ball 88 moves. The valve ball 88 is urged upwardly by a spring 89.

The bore 74 is similarly provided with an intermediate counterbore 91 in which O-ring seals 92 and 93 are mounted in axially aligned or tandem relation. An annular fitting 94 is mounted in a doubly counterbored portion 96. The tube 47 is mounted on a downwardly extending tubular portion 97 of the annular fitting 94. A ball valve 98 moves in a counterbore 99 in the fitting 94. A compression spring 101 urges the ball valve 98 upwardly.

Figure 5:
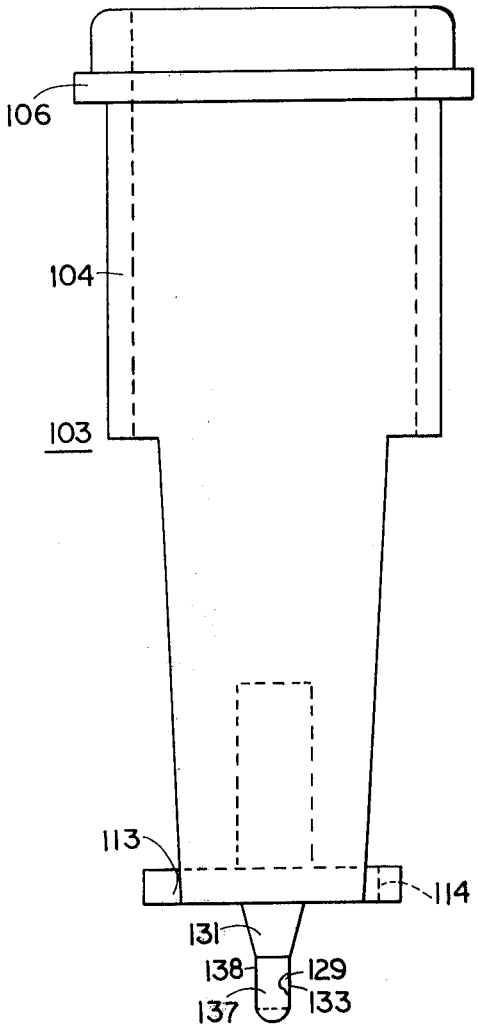
FIG. 5 is a view in side elevation of the housing removed from the device.

A removable spray housing 103 is removably mounted in the upper portion of the casing 61. The housing 103 includes an upper annular portion 104 (FIG. 5) provided with an outwardly extending flange 106. The flange 106 engages and extends outwardly beyond an upper edge 107 of the casing 61 (FIG. 2). An annular sheet metal valve supporting disc 108 is provided with a peripheral flange 109, which overlies and grips an upper edge portion 1091 of the housing 103. An annular cap 110 threaded on the casing 61 includes an inwardly directed flange 111 which engages the flange 106 to hold the housing 103 in position inside the casing 61. A lower transverse plate portion 113 of the housing 103 is provided with a slot 114 (FIG. 7) in which the rib 69 is received to align the housing 103 inside the casing 61. The flange 106 (FIG. 2) extends outwardly beyond the upper edge 107 of the casing 61 to permit gripping of the flange 106 for ease in removing the housing 103 from the casing 61.

Figure 7:
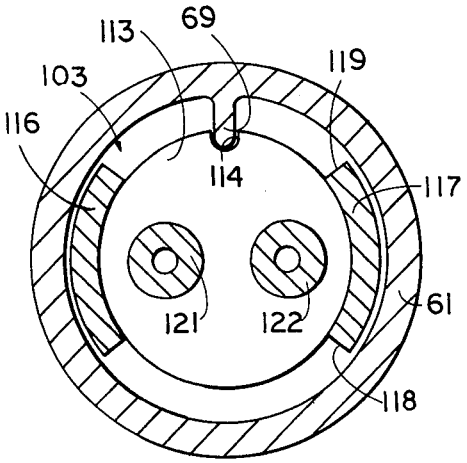
FIG. 7 is a view in section taken on line 7—7 in FIG. 2.
Figure 4:
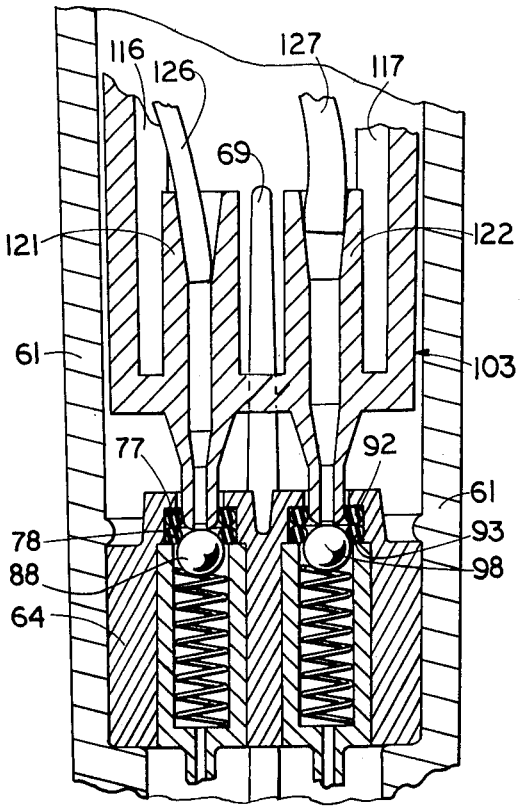
FIG. 4 is a fragmentary view in section taken on the same line as FIG. 2 but showing a housing of a spray head portion of the device in partly removed position.

The plate portion 113 is connected to the annular portion 104 (FIG. 5) by wall portions 116 and 117 (FIGS. 2 and 7), which are separated by windows 118 and 119 (FIG. 7). Upper tubular lugs 121 and 122 are mounted on the upper face of the plate portion 113 as shown in FIG. 2. Upper end portions of the lugs 121 and 122 have frusto-conic interior wall portions 123 and 124 which receive lower ends of tubes 126 and 127, respectively. The windows 118 and 119 permit access to the tubes 126 and 127 so that the tubes 126 and 127 can readily be positioned in the upper lugs 121 and 122, respectively. Lower tubular lugs 129 and 131 are mounted on the lower face of the plate portion 113 and communicate with the upper tubular lugs 121 and 122, respectively. As shown most clearly in FIG. 8, a lower end portion 132 of the lug 129 has a cylindrical outer wall 133, which can fit inside of and in sealing relation with the O-ring seals 77 and 78. The lower tip of the lower end portion 132 is provided with a transverse slot 134 to permit fluid from the interior of the counterbore 87 to enter a passageway 136 in the lug 129 passing around the ball valve 88 when the ball valve 88 is in the position shown in FIGS. 2 and 8. As shown in FIGS. 2 and 4, the lower tubular lug 131 has a similar lower end portion 137 provided with a cylindrical outer wall 138 (FIG. 5) which can fit inside of and in sealing relation with the O-ring seals 92 and 93 (FIGS. 2 and 4). When the cap 110 (FIG. 2) is unscrewed, the housing 103 can be removed upwardly, and, as the housing 103 reaches the position shown in FIG. 4, the ball valves 88 and 98 seat and seal against the seal rings 78 and 93, respectively, while the walls 133 and 138 of the lower end portions 132 and 137 of the lugs 129 and 131 are still in sealing relation with the seal rings 77 and 92, respectively. Thus, when the housing 103 is removed upwardly, the ball valves 88 and 98 seat before the housing 103 is removed sufficiently to break the seal at the seal rings 77 and 92, respectively, and the housing 103 can be removed without loss of liquid or air under pressure.

Figure 9:
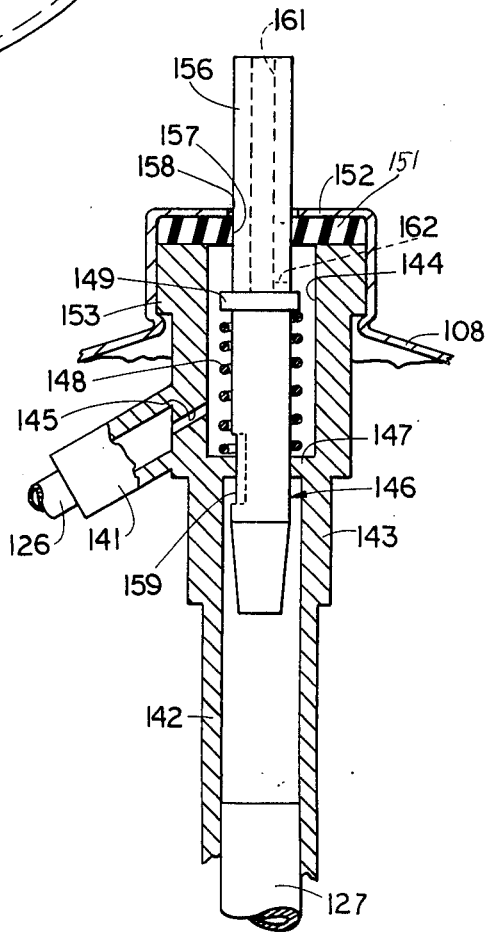
FIG. 9 is a fragmentary view in upright section on an enlarged scale showing a dispensing valve of the device in open position.

The tubes 126 and 127 (FIG. 2) are attached to a side arm 141 and a lower arm 142 of a valve housing 143. The valve housing 143 includes a central chamber 144 in which a valve plunger 146 operates. The side arm 141 communicates with the chamber 144 through a bore 145 (FIG. 9). An annular interior flange 147 (FIGS. 2 and 9) inside the housing 143 guides a lower portion of the plunger 146 and serves to back up a spring 148 which urges the plunger 146 upwardly. The spring 148 engages an annular flange 149 of the plunger 146 to normally hold the flange 149 against a sealing washer 151, as shown in FIG. 2. The washer 151 is held between an upper end of the housing 143 and a central portion 152 of the disc 108. The disc 108 is formed around a flange 153 of the housing 143 to hold the housing 143, the sealing washer 151 and the disc 108 in assembled relation. A hollow stem portion 156 of the plunger 146 extends upwardly through openings 157 and 158 (FIG. 9) in the sealing washer 151 and in the disc 108, respectively. When the stem 156 is pressed downwardly, an upright channel 161 in the stem 156 is in communication with the interior of the chamber 144 through a side channel 162. A slot or groove 159 in the plunger 146 provides an opening permitting liquid in the tube 127 to enter the chamber 144 when the plunger 146 is depressed. A dispensing cap 164 (FIG. 1) provided with a discharge passageway 166 can be mounted on the stem 156 for directing a spray.

When the stem 156 is depressed, liquid passes upwardly from the tube 127 (FIG. 9) through the opening provided by the slot 159 on the plunger 146 into the chamber 144. Compressed air also enters the chamber 144 from the tube 126 through the side arm 141 and the bore 145. The air and liquid mix in the chamber 144 and pass through the side channel 162 and the upright channel 161 of the stem 156 of the plunger 146 to be discharged through the dispensing cap 164 (FIG. 1).

The spray device is particularly useful in spraying hair treating liquids and solutions. These liquids and solutions tend to clog the narrow passageways as between the slot 159 (FIG. 9) of the plunger 146 and the valve housing 143. When the passageways become blocked, the cap 110 (FIGS. 1 and 2) can be unscrewed, and the housing 103 (FIG. 2) can be removed and replaced without need for releasing the pressure in the tubes 47 and 53.

Figure 16:
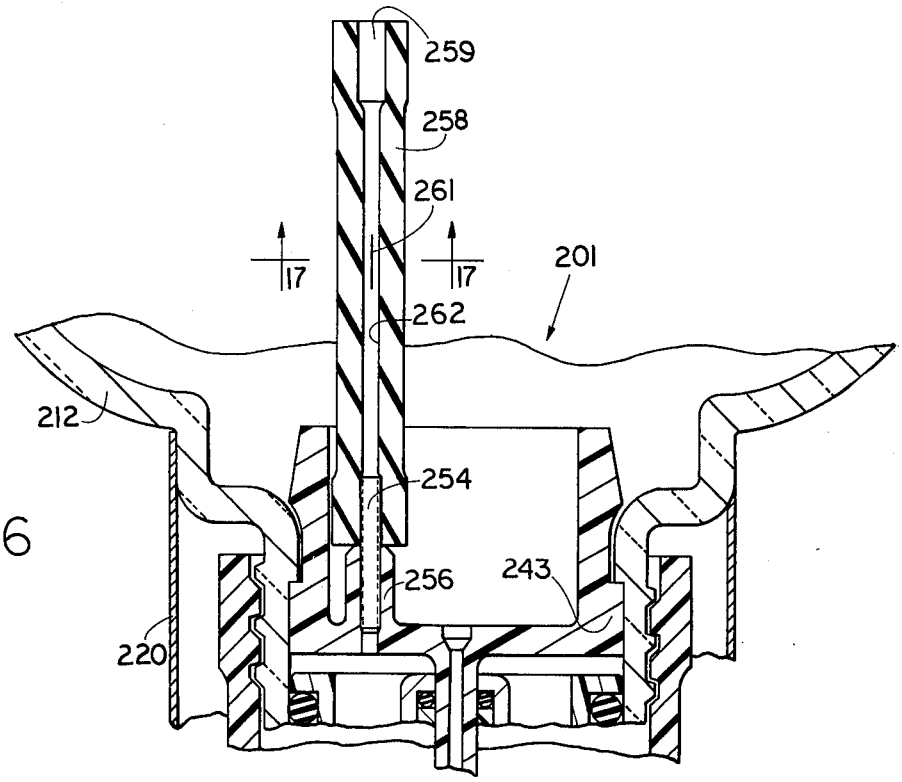
FIG. 16 is a fragmentary view in upright section of a bottle and dispensing assembly constructed in accordance with another embodiment of this invention.
Figure 17:
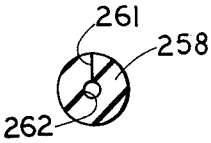
FIG. 17 is a view in section taken on the line 17—17 in FIG. 16.
Figure 17A:
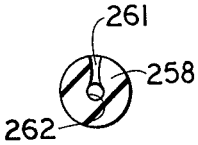
FIG. 17A is a view in section taken on the same line as FIG. 17, but showing an air discharge line under pressure.
Figure 17B:
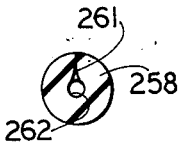
FIG. 17B is a view in section taken on the same line as FIG. 17, but showing the air discharge line under reduced pressure.

In FIG. 16 is shown a fragmentary part of a spray dispensing device 201 constructed in accordance with another embodiment of this invention. The device 201 includes a bottle 212 which is supported on a ring member 220. A plug 243 is mounted inside the bottle and includes a boss 256 in which a short tube 254 is mounted. A resilient tube 258 is mounted on the short tube 254. An upper end of the resilient tube 258 is closed by a plug 259. A short slit 261 is formed in the wall of the tube 258. Normally, the walls of the slit 261 are closed as shown in FIG. 17. If there is a greater pressure inside the bore 262 of the tube 258 than outside it, the slit 261 opens as shown in FIG. 17A to permit passage of air into the interior of the bottle 212 (FIG. 16). However, if the pressure inside the bore 262 is less than that outside the tube, the slit remains closed as shown in FIG. 17B, and the slit acts as a valve permitting flow of air into the bottle 212 (FIG. 16) but preventing flow from the bottle 12 into the interior of the tube 258. The tube 258 can be formed of resilient material which is unaffected by the liquid in the bottle, such as a silicone rubber or other rubber-like or rubber material.

In FIGS. 18 and 19 is shown a fragmentary portion of a head assembly 313 constructed in accordance with another embodiment of the invention. The head assembly 313 includes a housing 314 and a plug 316, both of which can be mounted inside a casing 315 in the manner of like elements of the device shown in FIG. 2. The spray housing 314 includes a plate portion 3161 on which are mounted tubular lugs 317 and 318. The lugs 317 and 318 extend into openings or bores 319 and 321, respectively, in the plug 316. The lug 317 includes an upper right circular cylindrical wall portion 323 and a lower right circular wall portion 324 separated by a shoulder 326.

A lower tip of the lug 317 includes bifurcations 327 and 328 on opposite sides of a central bore 329. The bifurcations 327 and 328 can engage a valve ball 331 as shown in FIG. 18 to displace the valve ball 331 from an O-ring valve seal 332.

The O-ring seal 332 is supported by a tubular insert 334 having an inwardly directed annular flange 336. The tubular insert 334 is mounted inside a doubly counterbored portion 338 of the bore 319. An annular fitting 339 is also mounted in the doubly counterbored portion 338 below the tubular insert 334. The O-ring seal 332 is mounted inside the tubular insert 334 between the inwardly directed annular flange 336 and an upper end 341 of the annular fitting 339.

A second O-ring seal 343 is mounted in the doubly counterbored portion 338 above the insert 334 and is held between an upper end of the insert 334 and a shoulder 346, which separates the doubly counterbored portion 338 from a counterbored portion 347 of the bore 319.

The valve ball 331 moves in a counterbore 349 in the fitting 339. A compression spring 351 urges the valve ball 331 upwardly.

The O-ring seal 332 can engage the wall portion 324 to form a seal therewith, and the O-ring seal 343 can engage the wall portion 323 to form a seal therewith. When the housing 314 is partially withdrawn from the plug 316, as to the position at which the lug 317 is shown in FIG. 19, the valve ball 331 seats against the O-ring seal 332 while the O-ring seal 343 engages the wall portion 323 so that there is no release of pressure inside the fitting 339 as the housing 314 is withdrawn. A downwardly extending tubular portion 352 of the fitting 339 can be connected to a source of fluid under pressure 353 (FIG. 18), and the central bore 329 can be connected to a tube 3531 to receive pressure in the manner like members of the device shown in FIG. 2 are connected.

The lug 318 and associated elements operate similarly to the lug 317 and associated elements. The lug 318 includes a wall portion 354, which can form a seal with an O-ring seal 356 and a second wall portion 357 therebelow. A valve ball 385 can engage an O-ring seal 360 mounted inside an annular insert 361 and held between an upper end 362 of an annular fitting 363 and an inwardly directed flange 364 of the insert 361. As the housing 314 is partially withdrawn from the casing 315 and the plug 316, the valve ball 385 seats against the O-ring seal 360 as indicated in dot-dash lines at 385A while the wall portion 354 engages the O-ring seal 356, so that there is no release of pressure inside the annular fitting 363 as the housing 314 is withdrawn. Other features of the head assembly 313 shown in FIGS. 18 and 19 can be similar to the structure described with relation to FIG. 2.

The spray dispensing devices illustrated in the drawings and described above are subject to structural modification without departing from the spirit and scope of the appended claims.

Having described our invention, what we claim as new and desire to secure by Letters Patent is:

1. In a spray dispensing device, the combination of a hollow casing, there being a socket in the casing having an annular cylindrical inner wall, a pair of O-ring seals of equal diameter mounted in the socket in coaxial aligned engaging relation, an annular valve guiding member at one end of the socket engaging one of the O-ring seals to retain said one of the O-ring seals in the socket, a ball valve mounted in the valve guiding member, means for urging the ball valve into engagement with said one of the O-ring sales to form a seal therewith, means for directing fluid under pressure into the valve guiding member, there being an inwardly directed annular shoulder at the other end of the socket engaging the other O-ring seal to retain said other O-ring seal in the socket, a housing removably mounted in the casing, there being a hollow lug having a cylindrical outer face mounted on the housing, the lug being received inside the O-ring seals in sealing relation therewith, and means for holding the housing in the casing with the lug engaging the ball valve to hold the ball valve open, the ball valve seating against said one of the O-ring seals when the housing is partially removed from the casing while the lug is in sealing engagement with the other O-ring seal.

2. A combination in accordance with claim 1 wherein a dispensing valve is mounted on the housing and means is provided for connecting the lug to the dispensing valve.

3. In a spray dispensing device, the combination of a hollow casing, there being a socket in the casing having an annular cylindrical inner wall, a pair of O-ring seals of equal diameter mounted in the socket in coaxial aligned relation, an annular valve guiding member at one end of the socket engaging one of the O-ring seals to retain said one of the O-ring seals in the socket, a ball valve mounted in the valve guiding member, means for urging the ball valve into engagement with said one of the O-ring seals to form a seal therewith, means for directing fluid under pressure into the valve guiding member, there being an annular shoulder at the other end of the socket engaging with the other O-ring seal, a hollow housing removably mounted in the casing, there being a hollow lug having a cylindrical outer face mounted on the housing, a dispensing valve mounted on the housing, a tube extending inside the housing and connecting the lug to the dispensing valve, the lug being received inside the O-ring seals in sealing relation therewith, and means for holding the housing in the casing with the lug engaging the ball valve to hold the ball valve open, the ball valve seating against said one of the O-ring seals when the housing is partially removed from the casing while the lug is in sealing engagement with the other O-ring seal, a wall of the housing being provided with a window providing access to the tube.

4. In a spray dispensing device, the combination of a hollow casing, there being a socket in the casing having an annular cylindrical inner wall, a pair of O-ring seals of equal diameter mounted in the socket in coaxial aligned relation, an annular valve guiding member at one end of the socket engaging one of the O-ring seals to retain said one of the O-ring seals in the socket, a ball valve mounted in the valve guiding member, means for urging the ball valve into engagement with said one of the O-ring seals to form a seal therewith, means for directing fluid under pressure into the valve guiding member, there being an annular shoulder at the other end of the socket engaging with the other O-ring seal, a housing removably mounted in the casing, there being a hollow lug having a cylindrical outer face mounted on the housing, a dispensing valve mounted on the housing, means for connecting the lug to the dispensing valve, the lug being received inside the O-ring seals in sealing relation therewith, an annular cap threaded on the casing and engaging the housing for holding the housing in the casing with the lug engaging the ball valve to hold the ball valve open, the ball valve seating against said one of the O-ring seals when the housing is partially removed from the casing while the lug is in sealing engagement with the other O-ring seal, there being an opening in the cap, the dispensing valve projecting through the opening in the cap.

5. A dispensing device for a bottle which comprises an annular cap threaded on a neck of the bottle, the cap having an inwardly directed flange overlying the neck of the bottle, a plug mounted inside the neck, there being a spout on the plug communicating with the interior of the bottle, a fitting assembly mounted inside the neck of the bottle between the flange and the plug, the fitting assembly having a central socket receiving the spout, a first O-ring seal between the fitting assembly and the neck of the bottle, a second O-ring seal between the spout and a wall of the socket, means connected to the socket for receiving liquid from the bottle, a tube mounted on the plug spaced from the spout and extending into the bottle, there being an opening in the fitting assembly spaced from the socket and connected to the tube, and means for directing air under pressure through the opening and the tube to cause flow of liquid from the bottle through the spout.

6. A dispensing device as in claim 5 wherein there are hook members mounted on the fitting assembly and extending outwardly of the cap inside the flange thereof, and a hollow guide member is releasably mounted on the hook members for surrounding the liquid receiving means and the air directing means.

7. A dispensing device as in claim 5 wherein the fitting assembly includes a generally cup-shaped first fitting including an annular wall received inside the neck of the bottle and an annular inner wall radially spaced from and coaxial with the outer wall, the walls of the first fitting being connected by a base plate, an annular second fitting having a wall received inside the outer wall of the first fitting and an outwardly extending annular flange overlying and spaced from the outer wall of the first fitting to define an annular slot holding the first O-ring seal, and an annular third fitting having a wall received inside the inner wall of the first fitting, there being an inwardly directed annular flange on the inner wall overlying and spaced from the wall of the third fitting to define an annular slot holding the second O-ring seal.

8. A dispensing device as in claim 7 wherein the opening in the fitting assembly is between the wall of the second fitting and the inner wall of the first fitting, and an air pressure line is connected to said opening.

9. A dispensing device as in claim 5 wherein there are hook members mounted on the fitting assembly and extending outwardly of the cap inside the flange thereof, a hollow guide member is releasably mounted on the hook members surrounding the liquid receiving means and the air directing means, and the closure includes a stand including a base, and a ring member mounted on and extending upwardly from the base, there being a slot in the ring member, the bottle being supported in inverted position on the ring member, the guide member having an opening opposed to the slot in the ring member through which the liquid receiving means and the air directing means extend.

10. A dispensing device as in claim 5 which includes a stand including a base, a ring member mounted on the base and extending upwardly therefrom, the bottle having a lower portion received inside an upper portion of the ring member and a shoulder on an upper edge of the ring member, there being a slot in the ring member underlying the bottle, an air line extending through the slot and in communication with the opening, and a liquid supply line connected to the spout and extending through the slot.

11. A dispensing device as in claim 5 wherein the tube includes a hollow portion of resilient material having a slit therein, a free end of the tube being closed, the slit expanding when there is air pressure inside the tube to permit air to enter the bottle, the slit closing when the pressure inside the tube is no more than that in the bottle.

12. A closure for a bottle which comprises an annular cap threaded on a neck of the bottle, the cap having an inwardly directed flange overlying the neck of the bottle, a plug mounted inside the neck, there being a central spout and an off-center port on the plug communicating with the interior of the bottle, and a movable fitting assembly mounted inside the neck of the bottle between the flange and the plug, the fitting assembly having a central socket receiving the central spout and an annular opening surrounding said socket communicating with the off-center port, said opening having tubular inlet and outlet mounts and providing continuous pneumatic communication between said tubular mounts and the off-center port when the fitting assembly is rotated through 360° around the central spout.

13. A closure as in claim 12 wherein there is an O-ring seal between the fitting assembly and the central spout.

14. A closure as in claim 12 wherein there is an O-ring seal between the fitting assembly and the neck of the bottle.

15. A closure as in claim 12 wherein there is a first O-ring seal between the fitting assembly and the neck of the bottle, a second O-ring seal between the fitting assembly and the central spout, and the O-ring seals are coaxial.

16. A closure as in claim 12 wherein there is a second spout on the plug at the off-center port communicating with the interior of the bottle, free ends of the spouts being substantially coplanar with a mouth of the bottle.

17. In a spray dispensing device, the combination of a hollow casing, there being a pair of sockets in the casing, each of the sockets having an annular cylindrical inner wall, a pair of O-ring seals of equal diameter mounted in each socket in coaxial aligned engaging relation, an annular valve guiding member at one end of each socket engaging one of the O-ring seals to retain said one of the O-ring seals in the socket, a ball valve mounted in each valve guiding member, means for urging each ball valve into engagement with the associated one of the O-ring seals to form a seal therewith, means for directing fluid under pressure into each of the valve guiding members, there being an inwardly directed annular shoulder at the other end of each socket engaging with the other O-ring seal associated therewith to retain said other O-ring seal in the associated socket, a housing removably mounted in the casing, there being a pair of hollow lugs each having a cylindrical outer face mounted on the housing, each of the lugs being received inside the O-ring seals associated with one of the sockets in sealing relation therewith, and means for holding the housing in the casing with each of the lugs engaging one of the ball valves to hold the ball valves open, each of the ball valves seating against one of the O-ring seals when the housing is partially removed from the casing while the lug is in sealing engagement with the other O-ring seal in the associated socket.

18. In a spray dispensing device, the combination of a casing, there being a pair of sockets in the casing, each of the sockets having an annular cylindrical wall, a pair of O-ring seals of equal diameter in each socket, means for holding the O-ring seals of each pair in engagement in their associated socket, a ball valve mounted in each socket, each ball valve being engageable with a first one of the O-ring seals in the associated socket to form a seal therewith, means for directing fluid under pressure into each socket to urge the ball valve thereof to seal forming position, a housing removably mounted in the casing, a pair of hollow lugs mounted on the housing, each lug having a cylindrical outer face, each lug being receivable in one of the sockets with the outer face in sealing relation with the other O-ring seal of the associated socket, each of the lugs being engageable with the ball valve of the associated socket to hold the ball valve open, each of the ball valves engaging in sealing relation with the first one of the O-ring seals in the associated socket when the housing is partially removed from the casing while the lug in the associated socket is in sealing relation with the other O-ring seal in the associated socket.

19. A spray dispensing device as in claim 18 wherein there is resilient means urging each ball valve to seal forming position.

* * * * *